US005232739A

United States Patent [19]

Strizki

[11] Patent Number: 5,232,739

[45] Date of Patent: * Aug. 3, 1993

[54] DUAL ORIFICE NOZZLE AND METHOD FOR INTERNALLY COATING CONTAINERS

[75] Inventor: Thomas C. Strizki, Denver, Colo.

[73] Assignee: Ball Corporation, Muncie, Ind.

[ * ] Notice: The portion of the term of this patent subsequent to Oct. 15, 2007 has been disclaimed.

[21] Appl. No.: 797,941

[22] Filed: Oct. 21, 1991

Related U.S. Application Data

[63] Continuation-in-part of Ser. No. 597,251, Oct. 15, 1990, Pat. No. 5,096,746.

[51] Int. Cl.[5] ..... B05D 7/22

[52] U.S. Cl. ..... 427/233; 427/234; 427/236; 118/317; 118/318

[58] Field of Search ..... 427/236, 233, 234; 239/550, 600; 118/317, 318

[56] References Cited

U.S. PATENT DOCUMENTS

| | | | |
|---|---|---|---|
| 2,124,853 | 7/1938 | Grupe | 118/317 |
| 2,466,182 | 4/1949 | Peeps | 299/143 |
| 3,697,313 | 10/1972 | Stumphauzer et al. | 427/233 |
| 4,378,386 | 3/1983 | Rehman | 427/233 |
| 5,096,746 | 3/1992 | Strizki | 427/236 |

FOREIGN PATENT DOCUMENTS 1201339 12/1959 France .

*Primary Examiner*—Shrive Beck
*Assistant Examiner*—Katherine A. Bareford
*Attorney, Agent, or Firm*—Gilbert E. Alberding

[57] ABSTRACT

A nozzle, nozzle assembly and method for internally coating containers uses a dual orifice nozzle and method to direct divergent distinct spray patterns at separate interior surface portions of the container where the coating liquid is required most. The nozzle comprises a generally cylindrical body having a forward portion, a middle portion, a rear portion, a first conduit passageway extending longitudinally therethrough terminating in a first opening disposed in the forward portion, and a second conduit passageway extending longitudinally therethrough terminating in a second opening formed in the forward portion of the nozzle body. The first and second conduit passageways direct the separate sprays of coating liquid generally forward of the nozzle body in separate distinct patterns diverging from one another with an acute included angle. The conduits are suited to receive airless nozzle inserts that direct the separate spray patterns at the distinct interior portions to thereby define a dual orifice nozzle assembly. In the internal coating method, a flow of coating liquid is divided into distinct first and second flow portions, with the first flow portion being directed toward one interior surface portion of the container and the second flow portion being directed toward a second interior surface portion of the container.

10 Claims, 5 Drawing Sheets

DUAL ORIFICE NOZZLE AND METHOD FOR INTERNALLY COATING CONTAINERS

This is a continuation-in-part application of U.S. patent application Ser. No. 07/597,251, filed Oct. 15, 1990, now U.S. Pat. No. 5,096,746.

TECHNICAL FIELD

This invention relates to systems and methods for internally coating containers, and more particularly relates to a dual orifice nozzle assembly and method for directing separate spray patterns at offset angles to coat distinct interior surfaces of a container.

BACKGROUND OF THE INVENTION

A method of metal container manufacture in current use by the metal container industry is the two-piece can process. This process involves forming a drawn cup from a metal sheet and then deep drawing the cup into a can configuration. After the can body is completely configurated and decorated, but before the end is assembled onto the body, the interior surface of the can body is coated with a protective coating of a synthetic resin material.

It is conventional practice to apply, as the coating material, a heat hardenable resin dispersed in an aqueous medium which is sprayed into the interior walls of the container. The open-ended can is caused to be passed through an internal coating station, commonly referred to as a "coating tunnel," where the coating liquid is sprayed into the interior of the can to coat its internal surface. The wet-coated container is then passed through an oven in which hot air is circulated to evaporate the aqueous medium and harden the coating.

In some conventional systems, the coating is sprayed into the interior of the container while the container is inverted in an upright position on a reticulated belt. In such systems, as the containers travel through the coating tunnel, the interior surface walls of the containers are contacted with an aqueous dispersion of a coating resin by spraying means, usually comprising a plurality of single orifice nozzles disposed under and along the reticulated belt, which direct a sequence of wide atomized sprays of wet resin coating onto the interior walls.

Substantially all the conventional nozzles used in such applications are of the single orifice type which make controlling the application of the coating to the interior surface difficult, especially near the open end of the container.

The airless nozzle most commonly used today in such applications includes an internal, hemispherical passage termination which is cut through by an external, V-shaped groove to form an elongated, elliptical-like orifice. Liquid material pumped at high pressures through such a spray nozzle is forced by the hemispherical termination of the passageway to converge in its flow at and through the elongated orifice. Because of the converging flow at the orifice, the liquid material is expelled through the orifice into a planar, expanding, fan-like film which breaks into spray particles which are carried by their momentum to the article target.

In the prior art, it was common during container manufacturing operations to simply excessively coat the interior of a container so that the "hard-to-reach" areas would receive a sufficiently thick layer of coating deposited thereon. This, naturally, left an excessively thick layer of coating in the "easy-to-reach" areas of the container. One attempt to cure this problem is disclosed by Stumphauzer, U.S. Pat. No. 3,697,313. The procedure of Stumphauzer results in a substantially uniform coating being applied over the interior surface of the sidewall of the container.

A further attempt to remedy this problem is disclosed by Rehman, U.S. Pat. No. 4,378,386. Rehman relates to a method and apparatus for applying a uniform coating to the interior surface of a container utilizing at least two nozzle means to apply the coating material. One of the nozzle means is operative to spray the lower portion of the cylindrical sidewall of the container while the other nozzle means is operative to spray the top portion of the sidewall and the crown or center section of the bottom wall. Rehman is especially intended for use with high solids or higher solids liquid coating materials. It is a specific object of Rehman to achieve a very even and uniform coating of the interior of the container.

Such prior systems are commonly plagued by excessive overspray and nozzle misting, each of which is costly due to the coating liquid that is wasted during such operations. It is more cost efficient to place more coating liquid on the interior areas where it is required most, that is, near the top and/or the bottom, particularly the bottom, of the container and less on the middle of the sidewall of the container as the top of the container is worked upon during the necking operation and the bottom of the container is in contact with the pin tip of the pin chain. The middle sidewall normally has minimal contact and consequently needs less coating.

Thus, there has developed in the metallic container manufacturing industry a need for an internal coating nozzle assembly capable of placing the coating where it is most required within the interior of the container, while also minimizing the amount of wasted coating liquid normally produced by an internal coating operation.

SUMMARY OF THE INVENTION

This invention presents a dual orifice nozzle assembly, device and method which forms two distinct and separate spray patterns offset at acute angles to spray or coat a specific interior area of a container with each respective pattern. An object of this invention is to provide the capability of more efficiently directing coating where it is required most inside the container while minimizing nozzle misting and overspray, thereby decreasing the amount of wasted coating liquid normally generated by the internal coating operation.

Generally, a preferred spray nozzle presented by the invention comprises a generally cylindrical body having a forward portion, a middle portion, a rear portion, a first conduit passageway extending longitudinally therethrough terminating in a first opening formed in the forward portion, and a second conduit passageway extending longitudinally therethrough terminating in a second opening formed in the forward portion of the body. The first and second openings, and preferably the passageways, are each oriented at an acute angle of approximately 20 degrees with respect to a central longitudinal axis of the nozzle body to accept spray forming means to direct separate sprays of coating liquid forwardly of the body and generally in separate patterns diverging from the central longitudinal axis of the nozzle. The middle portion of the nozzle body is generally cylindrical in shape and is smaller in diameter than the rear portion of the nozzle body, which is defined by a circular shoulder portion having a recessed cavity formed therein.

The first and second openings of the forward portion of the nozzle body are generally circular in shape and equally spaced on opposite sides of the central longitudinal axis. The first opening is preferably formed in a first planar surface which is substantially perpendicular to a longitudinal axis of the first conduit passageway, and the second opening is preferably formed in a second planar surface which is substantially perpendicular to a longitudinal axis of the second conduit passageway. The first planar surface of the forward portion of the nozzle body is disposed at an obtuse angle with respect to the second planar surface.

At their openings, each of the first and second conduit passageways has a beveled portion adjacent the forward portion of the nozzle body, a small diameter cylindrical portion adjacent the rear portion of the nozzle body, a large diameter cylindrical portion juxtaposed the beveled portion and an internally threaded portion interposed between the beveled portion and the large diameter cylindrical portion.

In use, the spray nozzle of the invention is intended to be arranged with respect to a container to be sprayed so that the longitudinal axis of the nozzle body is disposed at an acute angle in relation to a central longitudinal axis of the container.

In a preferred method of this invention, the first spray forming means of the nozzle body forms the first flow into a first spray pattern and directs the first spray pattern at a first interior portion of the container, which is preferably an area adjacent the open end of the container, and the second spray forming means of the nozzle body forms the second flow into a second spray pattern and directs the second spray pattern at a second interior portion of the container, which is preferably an area adjacent the closed end of the container.

The spray nozzle assembly, device and method presented by a preferred embodiment of this invention directs substantially all of the coating liquid onto the interior surface of the container where it is most effective and minimizes nozzle misting and overspray, thus decreasing wasted coating liquid. The direction of the first and second separate spray patterns near the closed end and the open end of the container results in a film deposited on the interior surface of the container having a greater thickness adjacent the ends thereof.

An alternative preferred embodiment of this invention provides a spray nozzle similar to the above-described spray nozzle except that the first passageway extends longitudinally through the spray nozzle substantially parallel to the central longitudinal axis of the nozzle body and the second passageway is oriented at an acute angle of approximately 26–29 degrees with respect to the central longitudinal axis. Both first and second passageways are adapted to accept spray forming means to direct separate sprays of coating liquid forwardly of the body and generally in separate diverging patterns. This alternative spray nozzle embodiment employs a lesser included angle between the first and second passageways to better facilitate the coating of the entire interior surface of the container with one pass of the container spray by the nozzle assembly in the coating tunnel.

Thus, an alternative preferred spray nozzle presented by the invention comprises a generally cylindrical body having a forward portion, a middle portion, a rear portion, a first conduit passageway extending longitudinally therethrough terminating in a first opening formed in the forward portion, and a second conduit passageway extending longitudinally therethrough terminating in a second opening formed in the forward portion of the body. The first opening, and preferably its corresponding passageway, is oriented substantially parallel with respect to a central longitudinal axis of the nozzle body. The second opening, and preferably its corresponding passageway, is oriented at an acute angle with respect to the central longitudinal axis of the nozzle body. Both openings are adapted to accept spray forming means to direct separate sprays of coating liquid forwardly of the body and generally in separate patterns diverging from one another.

The first and second openings of the forward portion of the nozzle body are generally circular in shape, but unlike the first embodiment, are unequally spaced on opposite sides of the central longitudinal axis of the nozzle. The first opening is preferably formed in a first planar surface which is substantially perpendicular to a longitudinal axis of the first conduit passageway, and the second opening is preferably formed in a second planar surface which is substantially perpendicular to a longitudinal axis of the second conduit passageway. The first planar surface is disposed substantially horizontally whereas the second planar surface is disposed at an obtuse angle with respect to the first planar surface.

In substantially all other aspects, the alternative embodiments of the spray nozzle are similar. The middle portions of their nozzle bodies are similarly generally cylindrical in shape and are smaller in diameter than the rear portions of the nozzle bodies, which are defined by circular shoulder portions having recessed cavities formed therein. At their openings, each of the first and second conduit passageways of the spray nozzles also diverge at acute angles and terminate at a beveled portion adjacent the forward portions of the nozzle bodies. Each of the spray nozzles also has a small diameter cylindrical portion adjacent the rear portions of the nozzle bodies, large diameter cylindrical portions juxtaposed to the beveled portions and internally threaded portions interposed between the beveled portions and the large diameter cylindrical portions.

In use, the alternative spray nozzle of the invention is intended to be arranged with respect to a container to be sprayed so that the longitudinal axis of the nozzle body is offset laterally of the central longitudinal axis of the container and at an acute angle of approximately 3–5 degrees.

In an alternative preferred method provided by this invention, the first spray forming means of the alternative nozzle body forms the first flow into a first spray pattern and directs the first spray pattern at a first interior portion of the container, which is preferably an area comprising the sidewall of the container and a portion of the crown or center section of the bottom wall, and the second spray forming means forms the second flow into a second spray pattern and directs the second spray pattern at a second interior portion of the container, which is preferably approximately the lower half portion of the sidewall adjacent to the closed end of the container.

The spray nozzle assembly, device and method presented by the alternative preferred embodiment of this invention directs substantially all of the coating liquid onto the interior surface of the container where it is most effective and minimizes nozzle misting and overspray, thus decreasing wasted coating liquid. The direction of the first and second separate spray patterns results in a film deposited on the interior surface of the container having a greater thickness adjacent to the closed end of the container, where coating is most desired.

The spray nozzles of this invention are adapted to threadably receive a first nozzle insert within the first conduit passageway adjacent the forward portion of the nozzle body for directing a first spray pattern generally toward a first interior portion of the container. Likewise, the second conduit passageway of the nozzle body is adapted to threadably receive a second nozzle insert adjacent the forward portion of the nozzle body for directing a second spray pattern generally toward a second interior portion of the container. Being received in the first an second conduit passageways, the first and second inserts and their longitudinal axes of the first preferred embodiment concomitantly lie at acute angles with respect to the central longitudinal axis of the nozzle. In the alternative preferred embodiment of the spray nozzle assembly, the first insert and its longitudinal axis lie substantially parallel to the central axis of the container, whereas the second insert and its longitudinal axis lie at an acute angle with respect to the central axis.

The spray forming means suitable for use with this invention are preferably generally cylindrical "airless" nozzle inserts having an externally threaded portion to allow them to be threadably received in the internally threaded portions of the first and second conduit passageways. The nozzle inserts act to form a fan-like spray pattern of the coating liquid as it is dispersed.

Thus, the invention provides a nozzle assembly, device and method that directs the internal coating liquid more accurately in two sprays whose axes diverge at an acute angle to deposit the coating liquid where it is most required inside the container, thereby reducing the amount of coating liquid required in the internal coating process. The invention reduces nozzle misting and overspray, which results in a reduction of man hours spent on cleaning the machines and this naturally increases the efficiency of the manufacturing process. Further, the nozzle assembly and device of this invention is less likely to blister than are conventional devices.

Further features of the invention will be apparent from the following drawings and disclosure of preferred embodiments of the invention.

Figure 1:
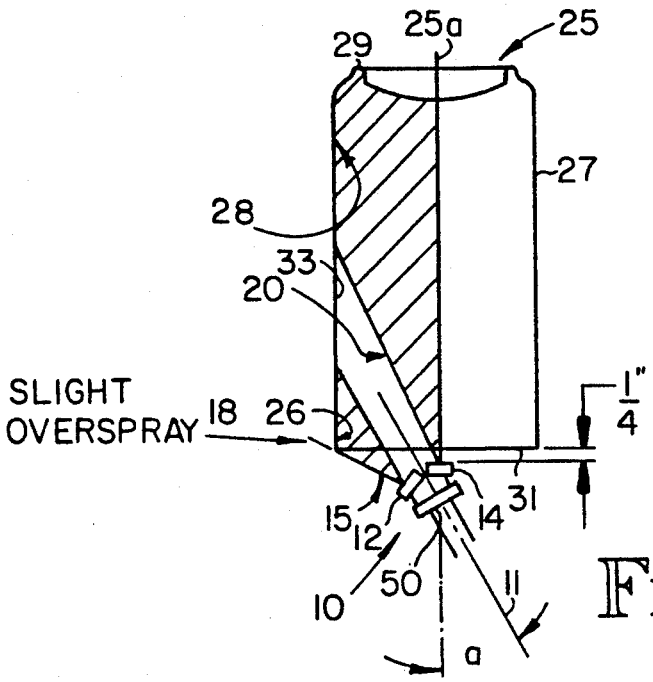
FIG. 1 is a plan view of the operating arrangement of a nozzle assembly for internal coating applications according to a preferred embodiment of this invention.

DETAILED DESCRIPTION OF THE PREFERRED EMBODIMENT AND BEST MODE FOR CARRYING OUT THE INVENTION

A preferred embodiment of this invention, including a spray nozzle 50, nozzle assembly 10 and a method of use presented by this invention, is shown and will be discussed in reference to FIGS. 1–4, wherein like reference numerals correspond to like components. An alternative preferred embodiment of this invention will be discussed hereinbelow in reference to FIGS. 6–9.

Referring now to FIG. 1, nozzle assembly 10 is intended to be arranged adjacent a container 25 as it is transported along in the manufacture process and includes nozzle 50 and nozzle inserts 12 and 14. Container 25 has a generally cylindrical body 27, an open end 31 and a closed end 29. Nozzle assembly 10 forms two distinct and separate spray patterns 15 and 20 that are directed at divergent angles at first and second interior portions 26 and 28, respectively, of the container 25. Thus, first spray pattern 15 is directed at first interior portion 26 of the container and second spray pattern 20 is directed at second interior portion 28 of the container. As noted above, it is at these interior areas 26 and 28 where more coating is desirable because the first interior portion 26 of the container is worked upon during the necking operation and the second interior portion 28 of the container is in contact with the pin tip of the pin chain during manufacture. The middle sidewall portion 33 normally has minimal contact and needs less coating during manufacture.

This invention decreases the amount of wasted coating liquid normally generated by the internal coating operation by minimizing misting and overspray 18 as shown in FIG. 1. The orientation of nozzle assembly 10 with respect to container 25 is such that with relative rotational movement of the container 25 and nozzle assembly 10, the entire bottom surface of the container 25 is coated. In use, nozzle assembly 10 is preferably arranged with respect to container 25 so that the longitudinal axis 11 of the nozzle assembly 10 is disposed at an acute angle "a" of approximately 28–31° relation to central longitudinal axis 25*a* of the container 25 and about one-quarter inch distance from the open end 31 of the container. This arrangement provides satisfactory coating of the container bottom with commonly available airless nozzle inserts.

Figure 2:
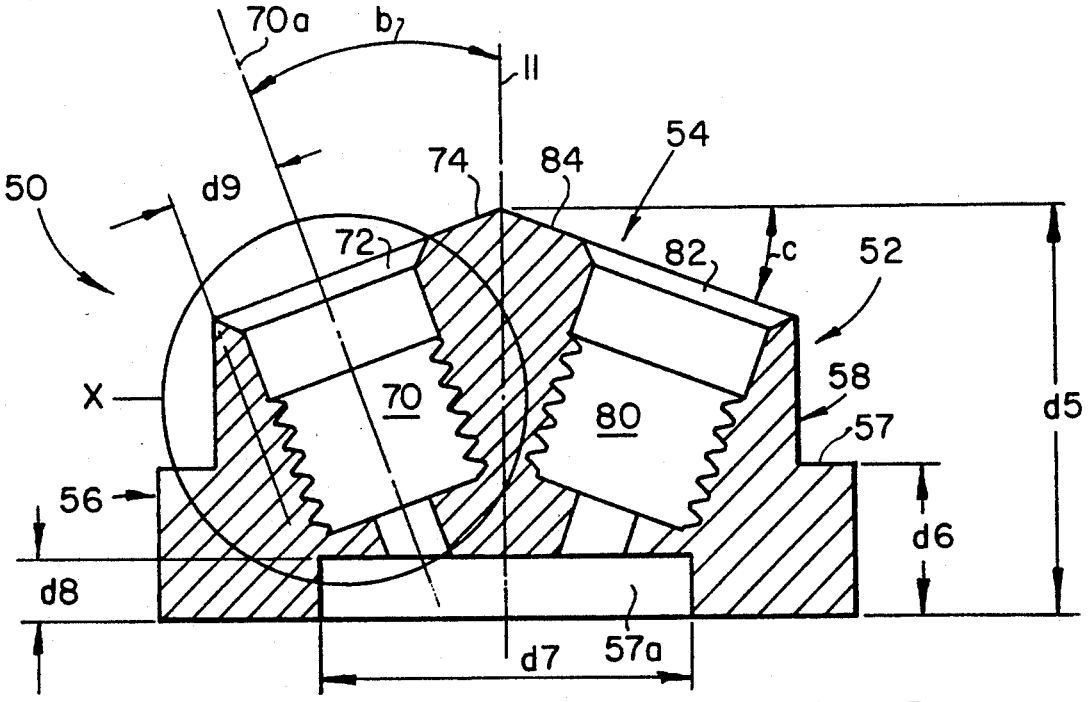
FIG. 2 is a cross-sectional view of a preferred embodiment of a spray nozzle, without nozzle inserts, provided by the invention taken along plane 2—2 of FIG. 3.
Figure 3:
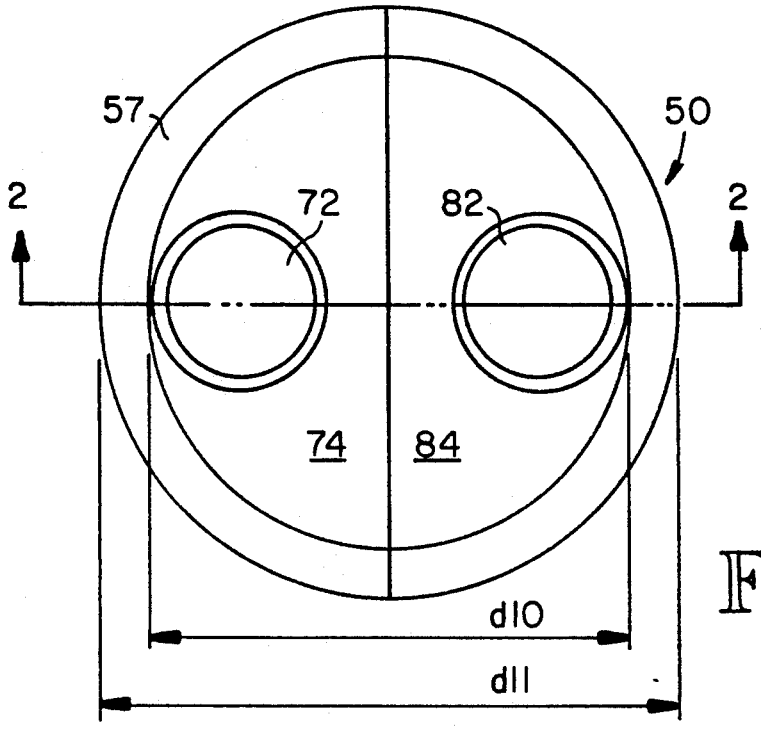
FIG. 3 is a top view of the spray nozzle of FIG. 2.

Nozzle 50 shown in FIGS. 2 and 3 comprises a generally cylindrical body 52 having a forward portion 54, a rear portion 56, an intermediate portion 58 and nonparallel first and second passageways 70, 80 formed in nozzle body 52. First conduit passageway 70 extends generally longitudinally through the nozzle body 52 and terminates in a first opening 72 disposed in the forward portion 54 of the nozzle. Likewise, second conduit passageway 80 extends generally longitudinally through the nozzle body 52 and terminates in a second opening 82 formed in the forward portion 54 of the nozzle. Conduits 70, 80 are each oriented within the nozzle body 52 at an acute angle "b" with respect to the central longitudinal axis 11 of the nozzle. Acute angle "b" is preferably about 20° . Thus, the divergent arrangement of conduits 70, 80 directs the separate spray patterns 15, 20 generally forward of the nozzle and in separate spray patterns diverging from the central longitudinal axis 11 of the nozzle.

First opening 72 is formed in a first planar surface 74 which is substantially perpendicular to the central longitudinal axis 70*a* of the first conduit 70. Second opening 82 is formed in a second planar surface 84 which is substantially perpendicular to a central longitudinal axis (not shown) of the second conduit 80. Planar surfaces 74 and 84 are each disposed at an acute angle "c" from horizontal. Angle "c" is preferably about 20° . Thus, the included angle between surfaces 74 and 84 is an obtuse angle of about 140° .

Intermediate portion 58 of nozzle body 52 is of generally cylindrical shape and rear portion 56 includes a circular shoulder portion 57 that has a diameter greater than the diameter of the intermediate portion 58. Shoulder portion 57 is provided with a recessed cavity 57*a* formed therein for connecting to a fluid-delivery line carrying the coating fluid from a remote source.

Figure 4:
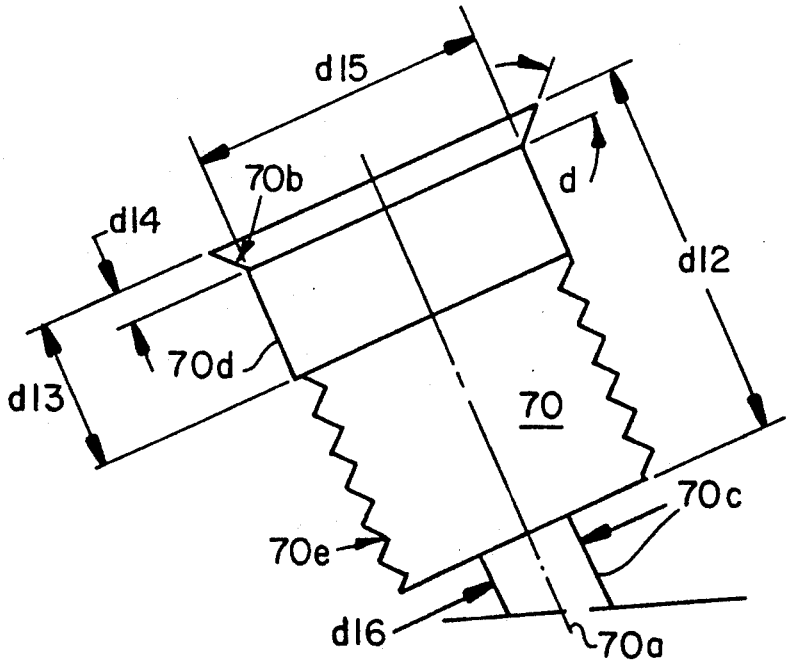
FIG. 4 is an enlarged, isolated partial cross-sectional view of one of the conduit passageways of the spray nozzle of FIG. 2.

Shown in FIG. 4 is an enlarged, isolated cross-sectional view of an encircled portion "X" of FIG. 2 containing conduit 70. While the description following herein is of the first conduit or passageway 70, said description is equally applicable to second conduit or passageway 80 as said passageways are substantially identical. Conduit 70 is formed in nozzle body 52 as having a beveled portion 70*b* adjacent the forward portion of the nozzle body, a small diameter cylindrical portion 70*c* adjacent the rear portion of the nozzle body, an enlarged diameter cylindrical portion 70*d* juxtaposed to the beveled portion 70*b* and an internally threaded portion 70*e* disposed between the large diameter cylindrical portion 70*d* and small diameter cylindrical portion 70*c*. Internally threaded portion 70*e* is preferably defined by four millimeter metric threads.

As shown in FIG. 3, first and second openings 72, 82 are generally circular in shape and are equally spaced on opposite sides of the central longitudinal axis of the nozzle body 52 along line 2—2.

Nozzle 50 of this invention is suited to threadably receive the nozzle insert members 12, 14 (FIG. 1) within the passageways 70, 80, respectively, adjacent the forward portion 54 of the nozzle body 52. First passageway 70 and corresponding nozzle insert 12 direct the first spray pattern 15 generally toward the first interior portion 26 of the container, whereas second passageway 80 and corresponding insert member 14 direct the second spray pattern 20 generally toward the second interior portion 28 of the container. Each nozzle insert 12, 14 preferably includes an internal, hemispherical passage termination which is cut through by an external, V-shaped groove to form an elongated, elliptical-like orifice. Coating liquid pumped under pressure through the nozzle insert is forced by the hemispherical termination of the passageway to converge in its flow at and through the elongated orifice. Because of the converging flow at the orifice, the coating liquid is expelled through the orifice into a planar, expanding, fan-like film which breaks into spray particles which are carried by their momentum to interior portions 26 and 28. Such nozzle inserts are of conventional design so their structure and specific manner of operation are not shown or described herein in detail. Nozzle inserts suitable for use with the nozzle 50 of this invention are manufactured by Nordson Corporation.

The method and device provided by this preferred embodiment of the invention may be further understood by reference to the following examples.

EXAMPLE ONE

Two internal coating lines were established to compare the dual orifice nozzle assembly 10 provided by this invention to a conventional "drum head," single orifice nozzle assembly. The dual orifice nozzle of this invention was coupled to an internal coating machine and was operated continuously for about two and one-half days at 160–170 mg spray weights using an internal coating fluid manufactured by Glidden, Model No. 559 IC coating. Overspray was captured by an overspray box. Sample test results are shown below in Table One:

TABLE ONE

| | Average Spray Wt. mg | Metal Exposure Average 1st Pass After Necker | Metal Exposure High | Metal Exposure Low |
|---|---|---|---|---|
| Dual orifice nozzle (35-can sample) | 167 mg | 1.0 mA | 2 mA | 0 mA |
| Control cans (35-can sample) | 198 mg | .89 mA | 2 mA | 0 mA |

The overspray box coupled to the internal coating machine equipped with nozzle assembly 10 of the invention did not require changing over the two and one-half day period during which the internal coater was operated whereas the conventional coating machine using the standard single orifice nozzle assembly generally required changing once per 12-hour shift. It is estimated that the dual orifice nozzle assembly of this invention reduced overspray by approximately 70 percent.

EXAMPLE TWO

A conventional spray gun equipped with the dual orifice nozzle assembly 10 of this invention was set up on a coating line and continuously operated in the 145–155 mg range. No metal exposure problems were incurred. Tests were also conducted to compare overspray, film weight distribution, and metal exposure with a standard internal coating set-up which employed a conventional single orifice drum head nozzle manufactured by Nordson, Model No. 092-064, equipped with a turbulence plate Model No. 027-309.

The two machines were operated approximately the same length of time and an overspray comparison was then made. The overspray boxes were emptied on both machines and the time was recorded; and, after 12 hours, the overspray boxes were again removed and weighed. The results are shown below in Table Two:

TABLE TWO

| | Gun with Conventional Single Nozzle | Gun with Dual Orifice Nozzle Assembly of this Invention |
|---|---|---|
| Overspray weight (12 hours) | 12 lbs. | 4.5 lbs. |
| Spray weight avg. | 151 mg | 153 mg |

A 50-can sample from each gun was then taken from the palletizer and checked for metal exposure. The results are shown below in Table Three.

TABLE THREE

| | Spray Weight | Metal Exposure Average | Metal Exposure High | Metal Exposure Low |
|---|---|---|---|---|
| Coater with Conventional Single Nozzle (Control) | 151 mg | .45 mA | 6 mA | 0 mA |
| Coater with Dual Orifice Nozzle of this Invention | 153 mg | .40 mA | 4 mA | 0 mA |

Figure 5A:
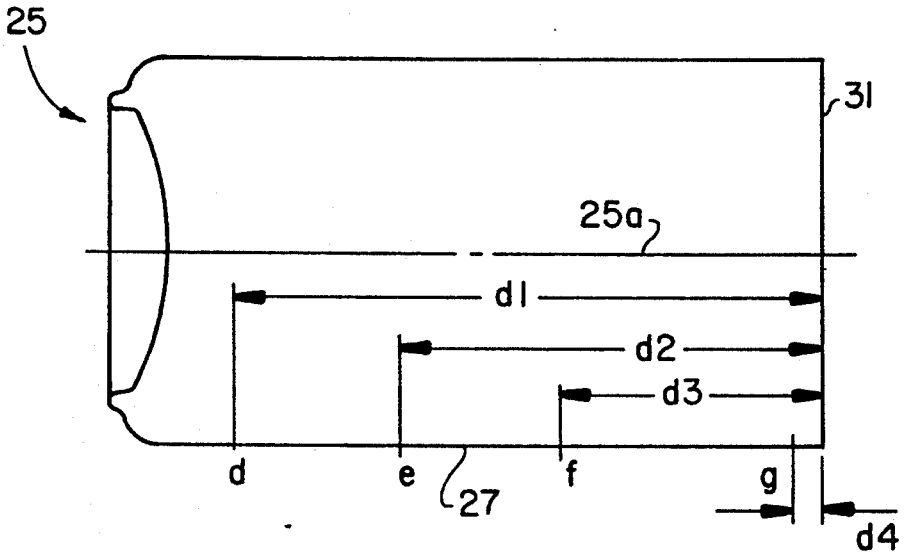
FIGS. 5A and 5B present graphical illustrations of the film thickness comparison achieved by a preferred embodiment of this invention.
Figure 5B:
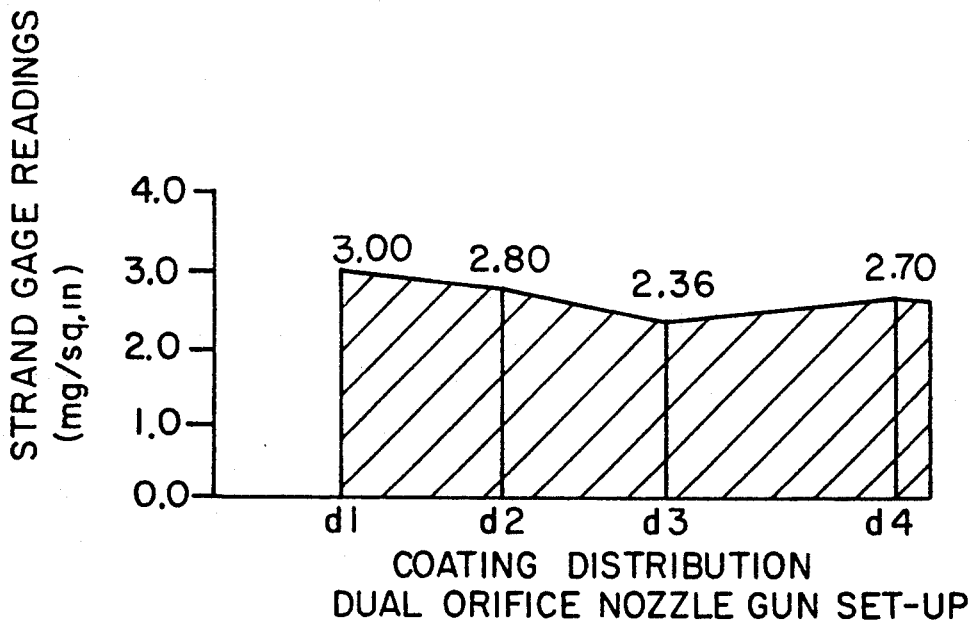

Further, the film weight distribution was then checked from the two machines with a strand gauge. FIG. 5A depicts a conventional "206" gauge aluminum container 25 and FIG. 5B illustrates the film thickness distribution of the coating liquid sprayed on the interior of the can measured at spaced points along the inside surface of the container body 27. As shown in FIG. 5A, the measurements were taken at points "d", "e", "f" and "g" which were at distances of 4.00 inches, 2.875 inches, 1.75 inches and 0.25 inches, respectively, measured from open end 31 of the container. The results of the gauge readings are illustrated in FIG. 5B in which milligrams per square inch of coating liquid is measured on the vertical axis and the distances d1, d2, d3 and d4 from which measurements at d, e, f and g, respectively, were taken are shown on the horizontal axis. The smallest measurement occurs at point "f" which generally corresponds to the middle portion 33 of the container wall as shown in FIG. 1. Measurements taken at points "d" and "e" generally correspond to the second interior portion 28 at which second spray pattern 20 is directed as shown in FIG. 1; and the measurements taken at point g generally correspond to the first interior portion 26 at which first spray pattern 15 is directed. Thus, the nozzle and method of this invention directs the internal coating liquid more efficiently where it is required most inside the can at interior portions 26, 28. While the strand gauge was not calibrated, the resulting values are useful for relative comparison. The readings represented in FIG. 5B were average readings taken from five can samples.

Lastly, the spray weights on the conventional control coater and the coater equipped with the dual orifice nozzle assembly of this invention were increased to 180–185 mg and checked for blistering. The dual orifice nozzle set-up did not blister at this weight whereas the conventional set-up produced moderate blistering.

Figure 6:
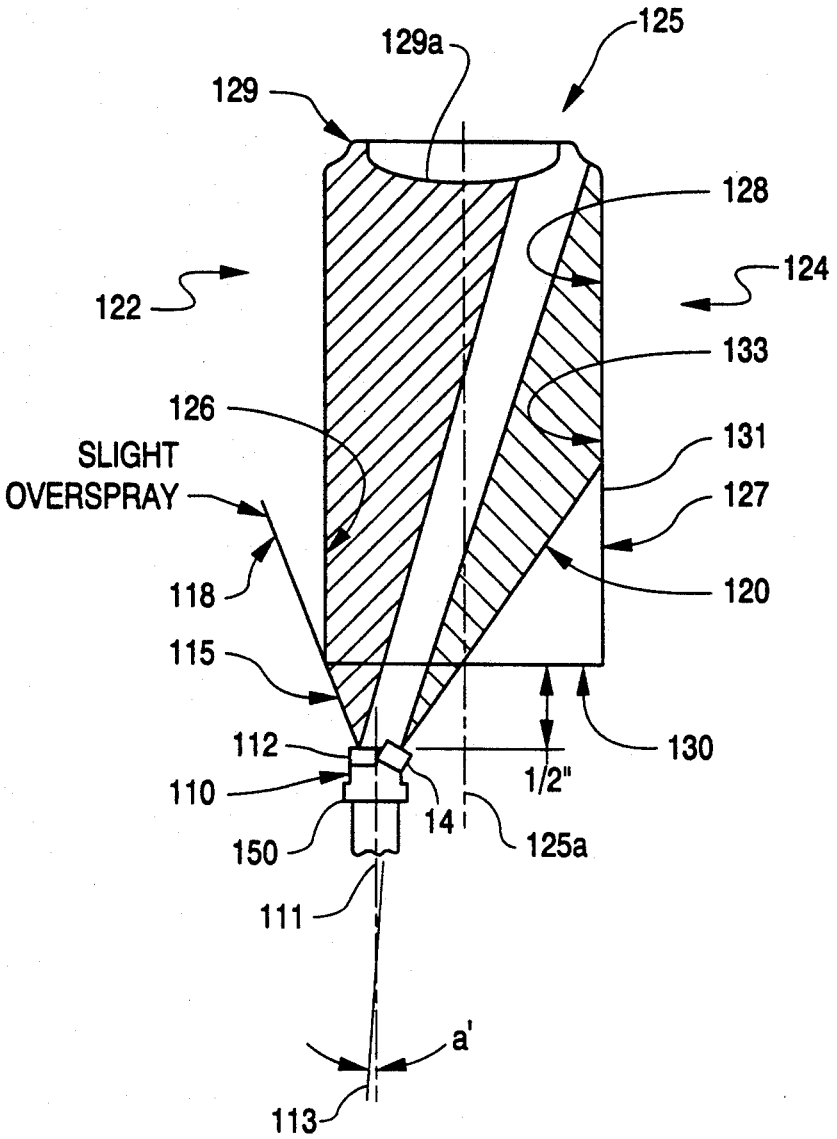
FIG. 6 is a plan view of the operating arrangement of a nozzle assembly for internal coating applications according to an alternative preferred embodiment of this invention.

An alternative preferred embodiment of this invention is shown and will now be discussed in reference to FIGS. 6–9, wherein like reference numerals correspond to like components. Referring now to FIG. 6, a nozzle assembly 110, which is intended to be arranged adjacent a container 125 as it is transported along in the manufacture process, includes a spray nozzle 150 carrying nozzle inserts 112 and 14. Container 125 has a generally cylindrical body 127, a closed end 129, a bottom wall 129*a*, an open end 130 and a sidewall 131. Nozzle assembly 110 is adapted to form two distinct and separate spray patterns 115 and 120 that are directed at divergent angles at first and second interior portions 122 and 124, respectively, of the container 125. First interior portion 122 preferably includes the entire length of sidewall 131 and a portion of the crown of bottom wall 129*a* of closed end 129. Second interior portion 124 preferably includes the middle portion 133 and the bottom portion 128 of sidewall 131. Thus, first spray pattern 115 is directed at first interior portion 122 of the container and second spray pattern 120 is directed at second interior portion 124 of the container.

This arrangement directs more coating liquid at the bottom portion 128 of sidewall 131, which is an area where more coating is desirable because the bottom portion 128 is in contact with the pin tip of the pin chain during manufacture. This invention decreases the amount of wasted coating liquid normally generated by an internal coating operation by minimizing misting and overspray referenced 118 in FIG. 6. The orientation of nozzle assembly 110 with respect to container 125 is such that with relative rotational movement of the container 125 and nozzle assembly 110, the entire interior surface of the container 125 is sufficiently coated.

In use, nozzle assembly 110 is preferably arranged offset laterally with respect to a central axis 125*a* of container 125 and so that the longitudinal axis 111 of nozzle assembly 110 is disposed at an acute angle a' of approximately 3–5 degrees in relation to a vertical reference line 113, which is parallel to central longitudinal axis 125*a* and about one-half inch distance from the open end 130 of container 125. As shown in FIG. 6, nozzle assembly 110 is preferably offset laterally to one side of axis 125*a* a distance of approximately one-quarter inch (0.25 in.), as compared to the arrangement of FIG. I wherein nozzle assembly 10 is disposed centrally of the central axis 25*a*. This arrangement provides satisfactory coating of the interior of a container with commonly available airless nozzle inserts.

Figure 8:
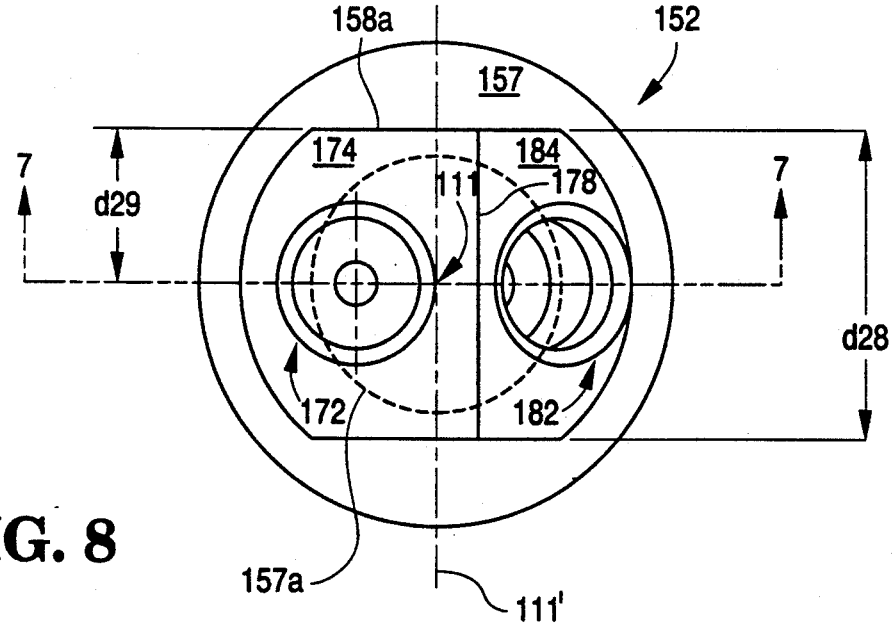
FIG. 8 is a top view of the spray nozzle of FIG. 7.
Figure 7:
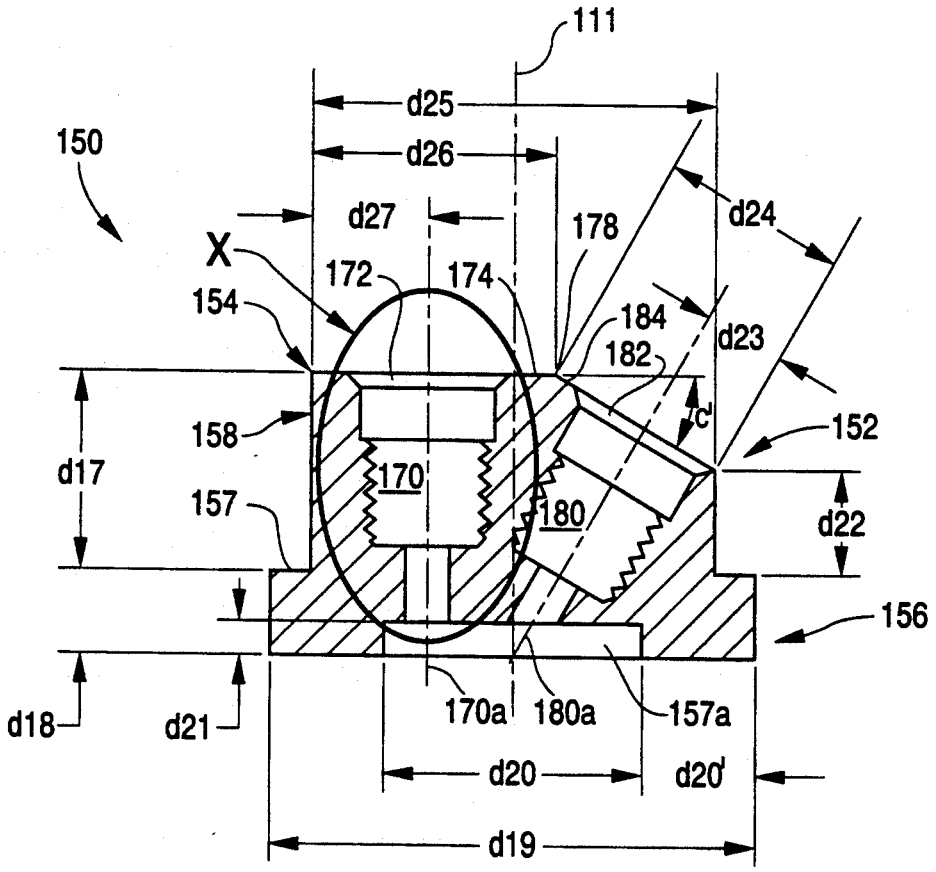
FIG. 7 is a cross-sectional view of an alternative preferred embodiment of a spray nozzle, without nozzle inserts, provided by the invention taken along plane 7—7 of FIG. 8.

Nozzle 150 shown in FIGS. 7 and 8 comprises a generally cylindrical body 152 having a forward portion 154, a rear portion 156, an intermediate portion 158 and nonparallel first and second conduit passageways 170 and 180, respectively, formed in nozzle body 152. First conduit passageway 170 extends generally longitudinally through the nozzle body 152 terminating in a first opening 172 disposed in the forward portion 154 and is oriented within nozzle body 152 so that its central longitudinal axis 170*a* is parallel to the central axis 111 of the nozzle body 152. Second conduit passageway 180 extends generally longitudinally through the nozzle body 152 terminating in a second opening 182 disposed in the forward portion 154 and is oriented within the nozzle body 152 at an acute angle c' with respect to vertical. Acute angle c' is preferably about 61–64 degrees, and most preferably, about 62.5 degrees. Thus, the divergent arrangement of conduits 170 and 180 directs the separate spray patterns 115 and 120 generally forward of the nozzle and in separate diverging spray patterns.

First opening 172 is formed in a first planar surface 174 which is substantially perpendicular to the central longitudinal axis 170*a* of the first conduit passageway 170. Second opening 182 is formed in a second planar surface 184 which is substantially perpendicular to a central longitudinal axis 180*a* of the second conduit passageway 180. Thus, first planar surface 174 is disposed substantially horizontally and thereby substantially perpendicular to central longitudinal axis 111, while second planar surface 184 is disposed at a preferred acute angle c' from horizontal and first planar surface 174 of approximately 26–29 degrees, most preferably about 27.5 degrees. The included angle between first and second planar surfaces 174 and 184 is therefore an obtuse angle of approximately 151–154 degrees, most preferably about 152.50 degrees.

Intermediate portion 158 of nozzle body 152 has a generally cylindrical shape with opposing milled flat sides 158*a* (FIG. 8) suitable for accepting an appropriately sized wrench or tool. Rear portion 156 includes a circular shoulder portion 157 that has a diameter greater than the diameter of the intermediate portion 158. Shoulder portion 157 is provided with a recessed cavity 157*a* formed therein for connecting to a fluid-delivery line carrying the coating fluid from a remote source.

Figure 9:
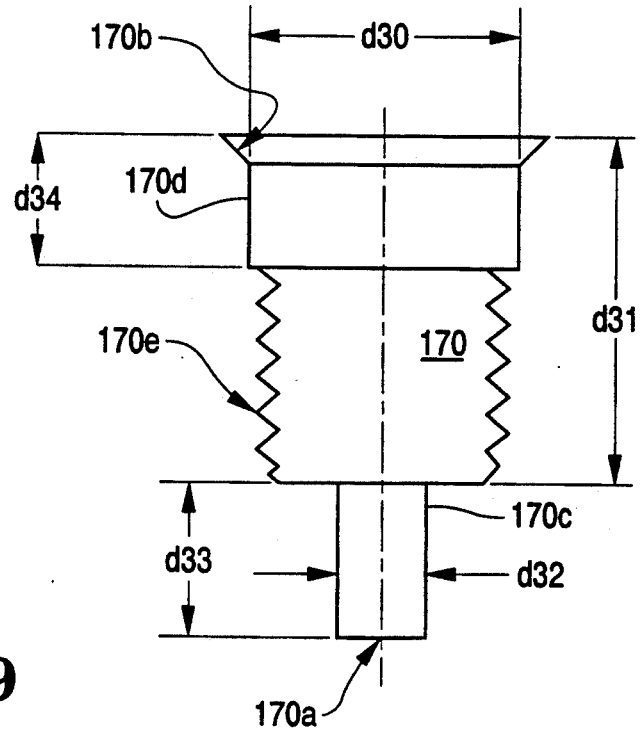
FIG. 9 is an enlarged, isolated, partial cross-sectional view of the first conduit passageway of the spray nozzle of FIG. 7.

Shown in FIG. 9 is an enlarged, isolated cross-sectional view of an encircled portion "X" of FIG. 7 containing first conduit passageway 170. While the following description is of the first passageway 170, the description is equally applicable to second conduit passageway 180 as said passageways, while they are oriented differently with respect to the central longitudinal axis 111 within nozzle body 152, are substantially identical in structure. First conduit passageway 170 is formed in nozzle body 152 as having a beveled portion 170b of approximately 0.020 inches and 41 degrees adjacent the forward portion 154 of the nozzle body 152, a small diameter cylindrical portion 170*c* adjacent the rear portion 156 of the nozzle body 152, an enlarged diameter cylindrical portion 170*d* juxtaposed to the beveled portion 170*b*, and an internally threaded portion 170*e* disposed between the large diameter cylindrical portion 170*d* and small diameter cylindrical portion 170*c*. Internally threaded portion 170*e* is preferably defined by four millimeter metric threads. As may be seen from comparing the passageways 70 and 170 shown in FIGS. 4 and 9, respectively, said passageways are substantially identical in structure, while their specific dimensions may differ slightly.

As shown in FIG. 8, first and second openings 172 and 182 are generally circular in shape arranged along a diameter of the generally cylindrical nozzle body 152, which diameter coincides with plane 7—7, and are spaced unequal distances on opposite sides of the central longitudinal axis 111 and a central latitudinal axis 111' of the nozzle body 152. First opening 172 is disposed a closer distance to central latitudinal axis 111' than is second opening 182, and a boundary 178 between first planar surface 174 and second planar surface 184 lies beyond latitudinal axis 111', the distance of which is referenced d26 in FIG. 7.

Nozzle body 152 of this invention is suited to threadably receive the nozzle insert members 112 and 14 (FIG. 6) within the passageways 170 and 180, respectively, adjacent the forward portion 154 of the nozzle body 152. First conduit passageway 170 and corresponding nozzle insert 112 direct the first spray pattern 115 generally toward the first interior portion 122 of the container, and second conduit passageway 180 and corresponding insert member 14 direct the second spray pattern 120 generally toward the second interior portion 124 of the container.

Nozzle insert member 14 is employable with both embodiments of the spray nozzle as shown in FIGS. 1 and 7. Nozzle insert member 112 is very similar in construction to nozzle insert members 12 and 14 in that it preferably includes an internal, hemispherical passage termination which is cut through by an external, V-shaped groove to form an elongated, elliptical-like orifice. Coating liquid pumped under pressure through the nozzle inserts is forced by the hemispherical termination of the passageway to converge in its flow at and through the elongated orifice. Because of the converging flow at the orifice, the coating liquid is expelled through the orifice into a planar, expanding, fan-like film which breaks into spray particles which are carried by their momentum to interior portions 122 and 124. As shown in FIG. 6, nozzle insert 112 preferably provides a wider spray pattern and, thus, a higher flow rate than nozzle insert 14. Nozzle inserts suitable for use with the nozzles 50 and 150 of this invention are manufactured by Nordson Corporation. Such nozzle inserts are of conventional design so their structure and specific manner of operation are not shown or described herein in detail.

The method and device provided by the alternatively preferred embodiment of the invention may be further understood by reference to the following example.

EXAMPLE THREE

Production testing of the alternatively preferred embodiment of the spray nozzle device provided by this invention was conducted to compare the performance of the alternative embodiment, that is, the dual-orifice spray nozzle having a first passageway arranged parallel to the central axis of the nozzle and a second passageway arranged at an acute angle in relation to the central axis, to a conventional spray gun set up, i.e., single-orifice spray nozzle. The tests were focused primarily on the extent of aluminum pick-up in the beverage liquid stored in the can at predetermined intervals. The extent of aluminum present in the beverage is generally inversely proportional to the sufficiency of the internal coating applied to the containers.

Once the containers making up the test group were internally coated, provided with end closures and filled with a beverage, Pepsi Cola® in this instance, the containers of a first study group were stored in an angled upright position (15 degrees) and the containers of a second study group were stored in an inverted position (upside down). The cans were internally coating with a coating liquid available from Glidden Corporation, grade no. 640-C-554. Selected cans from each study group were then pulled at initial, 30, 60, 90, 120 and 180 day intervals to determine the amount of aluminum in the liquid beverage measured as parts per million (ppm). The aluminum content was determined by atomic absorption spectroscopy. A common maximum allowance for this test, for example, is 2.5 ppm for 90 days.

Generally, the test results indicated that the amount of aluminum present in the beverage stored in containers internally coated by the alternatively preferred nozzle assembly and method of this invention was approximately two-thirds less than that of the cans coated by conventional internal coating methods. More particularly, the 120-day test showed the inverted cans increasing in aluminum content while the upright cans had lesser increases in aluminum content.

In the manufacture of the nozzle devices of this invention, Type 303 or 304 stainless steel is preferred. In addition, the dimensions referred to in the figures and listed below in Table Four are preferred:

TABLE FOUR

| Dimensions | Value (inches) | Angles | Degree |
|---|---|---|---|
| d5 | 0.0337 | a | 28–31 |
| d6 | 0.1250 | b | 20 |

TABLE FOUR-continued

| Dimensions | Value (inches) | Angles | Degree |
|---|---|---|---|
| d7 | 0.3125 | c | 20 |
| d8 | 0.0500 | d (bevel) | 41 |
| d9 | 0.0970 | a' | 3-5 |
| d10 | 0.4900 | c' | 62.5 |
| d11 | 0.5900 | | |
| d12 | 0.2000 | | |
| d13 | 0.0750 | | |
| d14 | 0.0200 | | |
| d15 | 0.1590 | | |
| d16 | 0.0520 | | |
| d17 | 0.2310 | | |
| d18 | 0.1000 | | |
| d19 | 0.5900 | | |
| d20 | 0.3130 | | |
| d20' | 0.1385 | | |
| d21 | 0.0400 | | |
| d22 | 0.1290 | | |
| d23 | 0.1000 | | |
| d24 | 0.2220 | | |
| d26 | 0.2930 | | |
| d28 | 0.3750 | | |
| d29 | 0.1875 | | |
| d30 | 0.1590 | | |
| d31 | 0.2000 | | |
| d32 | 0.0520 | | |
| d33 | 0.0910 | | |
| d34 | 0.0770 | | |

Thus, the dual orifice nozzles 50 and 150, nozzle assemblies 10 and 110 and the methods of operation provided by this invention deposit the internal coating liquid more efficiently where it is most required inside the can; reduce overspray by directing two separate, small, defined spray patterns at the desired interior portions of the can; reduce overspray by also decreasing the misting of the nozzle, and reduce the likelihood of blistering. In addition, the invention allows for the use of lower operating spray weights without compromising spray quality and blistering, which is a common problem with higher spray weights. These features, among others, reduce the amount of internal coating liquid required in such operations, as well as reducing man hours spent on cleaning the coating machines.

While what has been described constitutes a presently most preferred embodiment, the invention can take many other forms. Accordingly, it should be understood that the invention is to be limited only insofar as is required by the scope of the prior art and of the following claims.

I claim:

1. A method of applying an effective nonuniform coating within a container having a generally cylindrical shaped sidewall, an open end and a closed end defined by a bottom wall, said method comprising the steps of:

delivering a flow of coating material to single nozzle means for coating the interior of the container;

dividing the coating material flow within the single nozzle means into a first flow portion and a second flow portion having separate diverging patterns with maintained directions with respect to each other;

directing the first flow portion so its separate diverging pattern intersects a first interior portion of the container while directing the second flow portion so its separate diverging pattern intersects a second interior portion of the container; and providing relative rotation between said container and said first and second flows of coating material, said first and second flows of coating material applying a coating nonuniformly onto the first and second interior portions of the container.

2. A method of internally coating a container having a generally cylindrically shaped sidewall, an open end and a closed end defined by a bottom wall, said method comprising the steps of:

delivering a flow of coating liquid to a single nozzle means;

providing the single nozzle means and the container with relative rotation;

dividing the coating liquid flow into a first distinct flow portion and a second distinct flow portion within the single nozzle means;

directing the first distinct flow portion generally toward a first interior portion of the container and directing the second distinct flow portion generally toward a second interior portion of the container, said first and second distinct flow portions being directed at said first and second interior portions in separate diverging patterns forward of the single nozzle means; and directing a coating of greater thickness onto the sidewall of said container adjacent the closed end thereof, said first interior portion including the sidewall and a portion of the bottom wall of the container and said second interior portion including a portion of the opposing sidewall adjacent the closed end of said container.

3. The internal coating method as in claim 2 including the step of directing the first and second flow portions in separate diverging patterns at an angle of about 26–29 degrees with respect to one another.

4. The internal coating method as in claim 2 wherein said step of directing the flow portions in separate diverging patterns includes directing the first flow pattern along a central spray axis forwardly of the single nozzle means and substantially parallel with a central longitudinal axis of the single nozzle means, and directing the second flow pattern in an angled direction forwardly of the single nozzle means along a central spray axis lying at an acute angle with respect to the central longitudinal axis of said single nozzle means.

5. The internal spraying method as in claim 4 including the step of arranging the central longitudinal axis of the single nozzle means offset laterally from and at an included acute angle of about 3–5 degrees with respect to the longitudinal central axis of the container being coated.

6. The internal coating method as in claim 2 wherein the single nozzle means comprises:

a body having a forward portion, a middle portion, a rear portion, a first conduit extending generally longitudinally therethrough terminating in a first opening disposed in the forward portion, and a second conduit extending generally longitudinally therethrough terminating in a second opening formed in the forward portion, said first opening being oriented in a plane disposed normally to the central longitudinal axis of the single nozzle means to direct the first flow portion of the coating liquid in a first distinct pattern, said second opening being oriented in a plane disposed at an acute angle of about 26–29 degrees with respect to the central longitudinal axis of the single nozzle means to direct the second flow portion of the coating liquid in a second distinct pattern.

7. The internal coating method as in claim 6 wherein said single nozzle means further comprises:

a first nozzle insert member positioned with the first conduit adjacent to the forward portion for directing the first spray pattern generally toward the first interior portion of the container; and a second nozzle insert member positioned within the second conduit adjacent to the forward portion or directing the second spray pattern generally toward the second interior portion of the container.

8. The internal coating method as in claim 7 wherein the first and second nozzle insert members are generally cylindrical and have an externally threaded portion, and wherein the first and second conduits each have internally threaded portions to threadably receive therein the first and second nozzle insert members, respectively, adjacent to the forward portion of the nozzle means.

9. The internal coating method as in claim 2 wherein the first and second flow portions and separate diverging patterns are formed without the use of compressed air by first and second airless nozzle insert members carried by said single nozzle means.

10. A method of applying an effective non-uniform coating within a container having a generally cylindrical shaped sidewall, an open end and a closed end defined by a bottom wall, such method comprising the steps of:

delivering a flow of coating material to a single applicator having a pair of orifices for coating the interior of the container;

dividing the coating material flow within the single applicator into a first flow portion and a second flow portion having separate diverging patterns with maintained directions with respect to each other;

directing the first flow portion with a first orifice of said pair of orifices so its separate diverging pattern intersects the sidewall and a portion of the bottom wall while directing the second flow portion with a second orifice of said pair of orifices so its separate diverging pattern intersects a portion of the sidewall adjacent to the closed end of said container; and providing relative rotation between said container, said applicator and said first and second flows of coating material, said first and second flows of coating material applying a coating of greater thickness onto the sidewall of the container adjacent the closed end thereof.

* * * * *